US005421802A

United States Patent [19]

Landeck et al.

[11] Patent Number: 5,421,802

[45] Date of Patent: Jun. 6, 1995

[54] REGISTRATION PROCESS

[75] Inventors: Harry A. Landeck, Tolland; Alan F. Savicki, South Windsor, both of Conn.

[73] Assignee: First Brands Corporation, Danbury, Conn.

[21] Appl. No.: 81,906

[22] Filed: Jun. 23, 1993

[51] Int. Cl.[6] ..... B31B 1/16

[52] U.S. Cl. ..... 493/22; 364/471; 364/472; 364/473; 83/76.8; 83/371; 493/14; 493/18; 493/196

[58] Field of Search ..... 493/13–15, 493/17, 18, 22–24, 29, 194, 195, 196; 83/76.8, 371; 364/471, 472, 473

[56] References Cited

U.S. PATENT DOCUMENTS 4,368,051 1/1983 Lehmacher ..... 493/196
4,605,392 8/1986 Achelpohl ..... 493/196
4,609,366 9/1986 Ley ..... 493/22
4,925,438 5/1990 Wagner ..... 493/194

*Primary Examiner*—Jack W. Lavinder
*Attorney, Agent, or Firm*—Gary L. Wamer

[57] ABSTRACT

The present invention features a high-speed registration system for the manufacture of plastic bags. The system has a registration apparatus that senses the leading and trailing edge of each sinusoidally-shaped tie pattern from a continuous web. Each sinusoidally-shaped tie is associated with an individual bag entity and, therefore, represents a midway point for each bag to be cut from the continuous web. The leading and trailing edge of each sinusoidally-shaped tie, therefore, is used to determine the center line of each bag. A plurality of center line determinations are averaged upstream of the sizing apparatus. When a detected entity finally reaches the downstream sizing apparatus, the cutting of the individual bag unit from the web is accomplished about an accurate, but "floating", center line

14 Claims, 2 Drawing Sheets

REGISTRATION PROCESS

FIELD OF THE INVENTION

The present invention pertains to the sizing, folding and stacking of plastic bags, and, more particularly, to a variable-speed, mechanical, positive-feed apparatus for registering, sizing, folding and stacking plastic tie bags at high speed.

BACKGROUND OF THE INVENTION

The flexible plastic bag is one of the most ubiquitous commodities in commercial usage today. There are many different designs and methods for manufacturing these bags. The plastic bags of the present invention have integral, sinusoidally-shaped ties cut into the plastic bag body. Bags of the type described in the present invention are shown in U.S. Pat. No. 4,890,736, issued to Greyvenstein on Jan. 2, 1990.

Current plastic bag manufacture involves utilizing thinner plastic materials that are folded and stacked at ever increasing speeds. Thinner plastic reduces the landfill space. In addition, more of the thinner bags can be packaged in a given container, or, conversely, a smaller package can accommodate the same number of thinner bags.

Thinner bags, however, increase manufacturing problems. Most particularly affected are the folding and stacking operations.

As production speed increases, the registration of the bags becomes more difficult. There is less tolerance in the proper location of a bag disposed in the speeding web as it is introduced to a sizing, folding or stacking operation. A criticality develops as the product is transferred from one feed mechanism to another in the chain of manufacturing operations. Hence, it becomes imperative to provide more direct and positive feed systems, so that the bag bodies will not wrinkle, ripple, jam, flap or cause interruptions in the manufacturing operations.

The registration of a bag as it is separated from the continuous web of material can no longer be treated as one in a series of items to be handled. Rather, the high speed necessitates that registration sensing must take place in advance of the actual cutting and sizing of the bags. The present invention reflects the discovery that such forward registration techniques must use a "floating" average of several bag locations as they are sensed upstream. The averaging of a plurality of bag location signals provides a trend adjustment for registration that is suitable (i.e., within tolerance) for the high-speed cutting operation, utilizing the center line for each bag being introduced to the sizing and cutting apparatus downstream.

DISCUSSION OF RELATED ART

In U.S. Pat. No. 4,906,228, issued on Mar. 6, 1990, to Reifenhauser et al, entitled METHOD AND APPARATUS FOR THE MANUFACTURE OF PLASTIC BAGS IN PAIRS WITH SIDE SEAMS, an apparatus for bag ties is illustrated. The wave crests and wave troughs that are characteristic of the tie patterns of this invention are cut through the center of the sheet body, thus forming two oppositely facing bags. The ties are then folded downwards, in whole or in part, along a continuous fold line. The fold can be toward either the inside or the outside of the bag. The ties are then welded to the bag body. Thereafter, holes are punched in the folded and welded portions, forming a handle.

The aforementioned bag manufacturing method differs from the current invention in that the registration of the bags is achieved by scanning the inner or outer edges of the wave crests and troughs to convey them synchronously. Although not clearly described in the reference, this scanning is, nonetheless, a process step which is completely alien to the present invention. The method described for the current invention needs no complicated scanning or electronics to achieve registration. Rather, the invention uses a simple sensing of the leading and trailing edges of each sinusoidally-shaped tie. The leading and trailing edges are used to determine a center line for each bag unit disposed in the continuous web. The center line determinations are averaged ahead of the cutting apparatus in order to provide center line adjustment.

SUMMARY OF THE INVENTION

In accordance with the present invention, there is provided a high-speed registration system for the manufacture of plastic bags. The system comprises a registration apparatus that senses the leading and trailing edge of each sinusoidally-shaped tie pattern in a continuous web. Each sinusoidally-shaped tie is associated with an individual bag entity and, therefore, represents a mid-portion for each bag to be cut from the continuous web. The leading and trailing edge of each sinusoidally-shaped tie, therefore, is used to determine the center line of each bag. At high speed, this is essentially the only way that individual bag bodies can be cut from a fast-moving web. The determination of an "in tolerance" floating center line can also be used to "feed-back" adjust for changes in the speed of the moving web, if it is determined that the averaged, center-line data is shifting out of the tolerance range.

It is an object of the present invention to provide a high-speed registration system for the fabrication of flexible plastic bags.

It is another object of this invention to provide a high-speed registration system that allows for web speed variations in the manufacture of flexible, plastic tie bags.

BRIEF DESCRIPTION OF THE DRAWINGS

A complete understanding of the present invention may be obtained by reference to the accompanying drawings, when considered in conjunction with the subsequent detailed description, in which.

For the sake of brevity and clarity, like elements and components will bear the same designation throughout the FIGURES.

DESCRIPTION OF THE PREFERRED EMBODIMENT

Generally speaking, the invention features a registration system for a high-speed web of flexible, plastic material that is to be sized and cut into individual bags. Because of the extremely high speed and flexibility of the web, the registration system relies upon a unique average of the center line of a plurality of individual bags as they approach the sizing and cutting station. The "floating" center line value is not the actual center line as may exist for that portion of the web positioned between the cutting or sizing elements. Rather, it is a calculated center line for a number of bags, based on the sensed position of the leading and trailing edges of the sinusoidally-shaped ties of each bag unit. The ties, by definition, are each cut to be in the center of the bag unit as the bag is cut from the moving web. The average of the center lines of the bags approaching the sizing station actually represents where the position of the center of the tie should be, based on the web speed. The "floating" center line determination is a calculated position well in tolerance with the actual center line.

Figure 1:
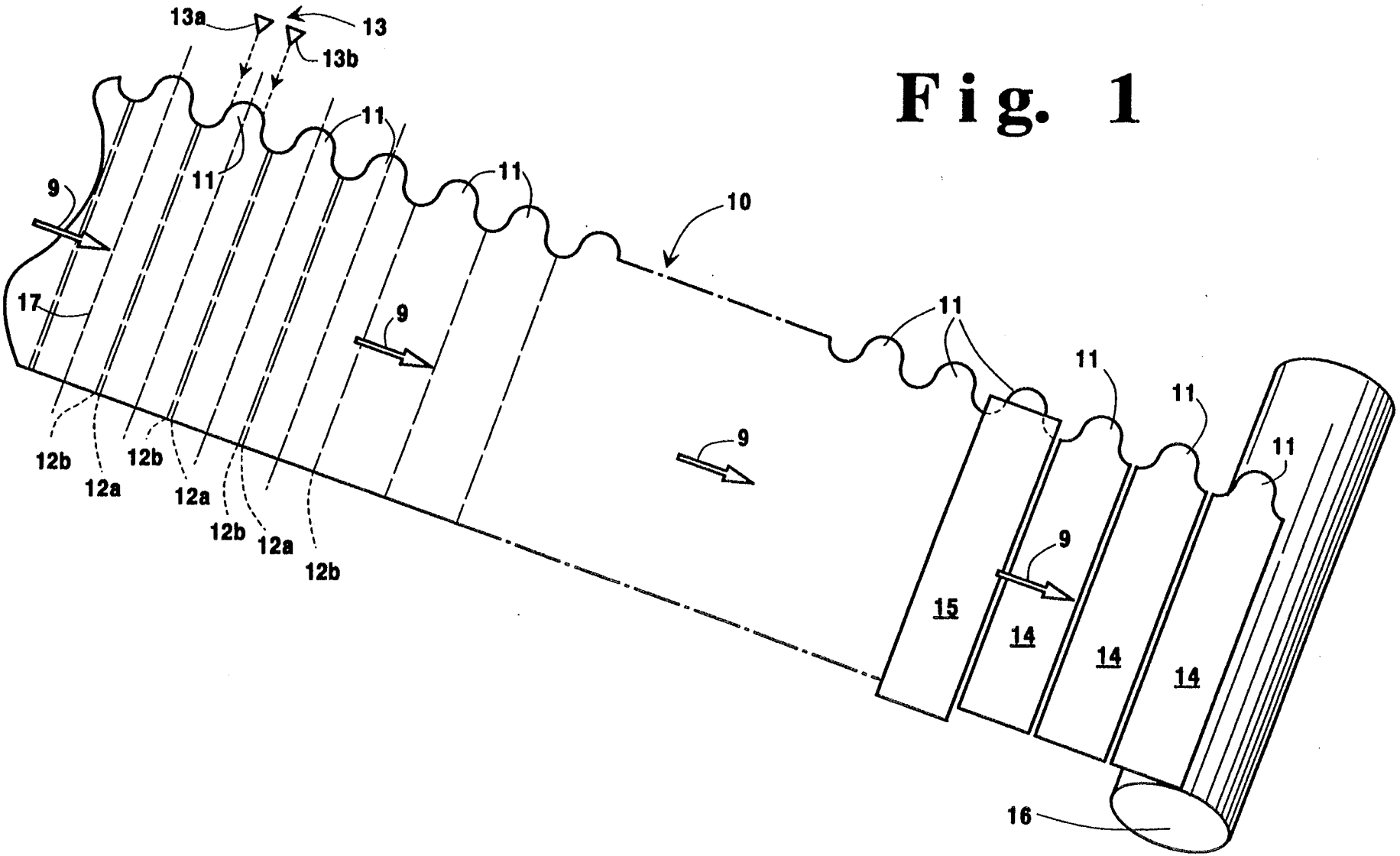
FIG. 1 illustrates a schematic diagram of the web movement and sensing arrangement for the registration system of the invention.

Now referring to FIG. 1, a continuous web 10 of flexible plastic is shown, moving along a feed path represented by arrows 9. The web 10 has integral tie units 11 for each bag unit 14 to be cut, as indicated by the phantom side boundaries 12*a* and 12*b*, respectively. The leading and trailing edges, 11*a* and 11*b*, of each tie 11 are sensed by sensors 13*a* and 13*b*, respectively, as each tie 11 in the moving web 10 passes the tie sensor station 13. The sensing of the leading and trailing edges 11*a* and 11*b*, respectively, is used to calculate the center 17 of each bag unit 14. The individual bag units are cut at the sizing station 15 located downstream of sensors 13*a* and 13*b*, based on the calculated center line 17 of each bag unit 14. The registration apparatus takes an average of the plurality of center lines 17 that is determined by all of the respective ties 11 disposed between the sensor station 13 and the sizing station 15.

In the particular embodiment of this invention, seven ties 11, or seven bag units 14, are disposed between the sensors and the sizing station 15. Therefore, the information reaching the sizing station is a "floating" center line of the average of the last seven bag units 14. While an average of seven bag units will provide a good ballpark figure for the true center line position, the number of units chosen to ascertain an average is a matter of choice.

The sizing station 15, located downstream of sensors 13*a* and 13*b*, cuts individual bag units 14 from the moving web 10, utilizing a hot knife (not shown). The individual bag units 14 are then individually fed seriatim to a folding apparatus (not shown).

Figure 2:
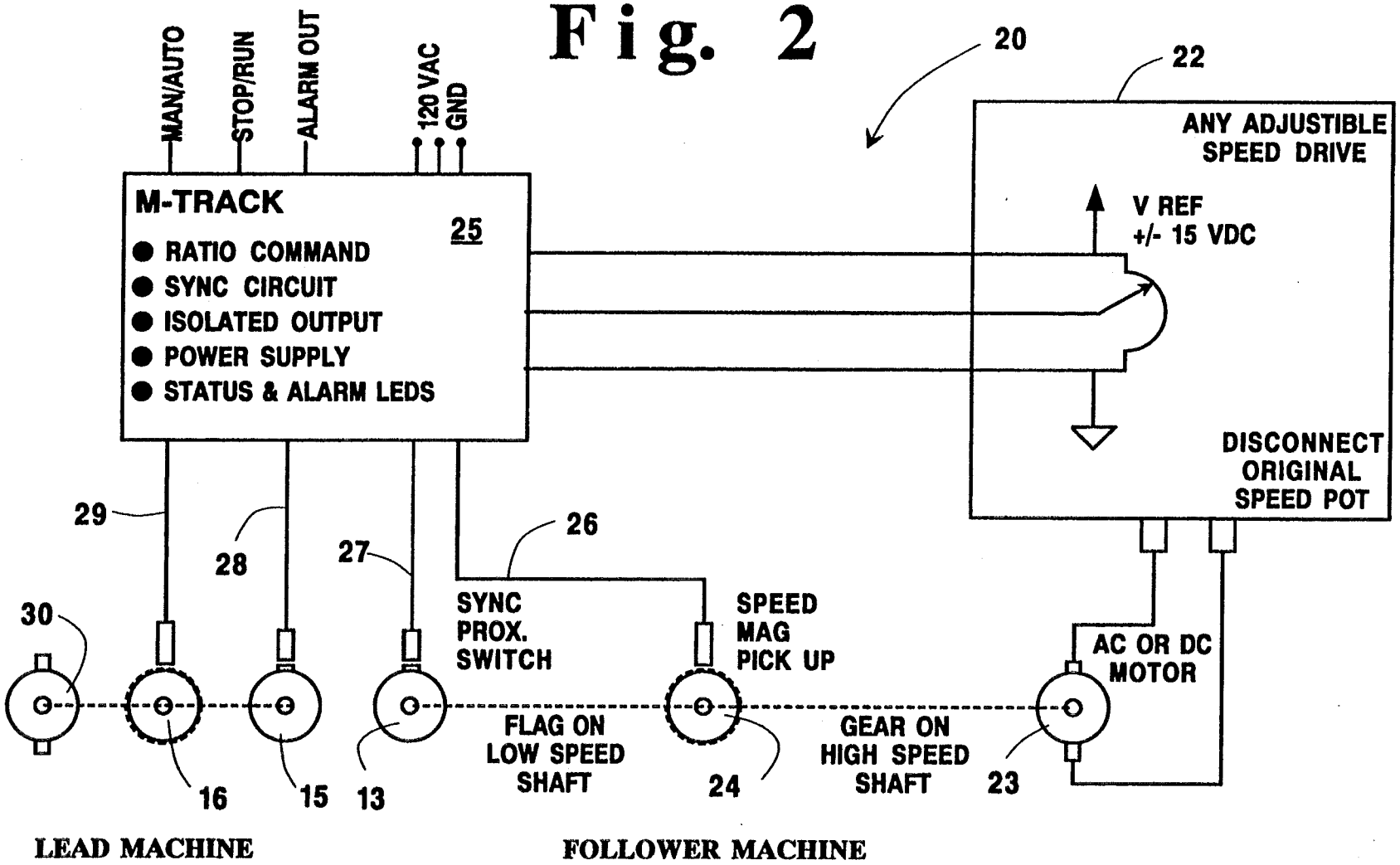
FIG. 2 is a schematic, electromechanical diagram of the registration control system, in accordance with the invention.

Referring now to FIG. 2, the electromechanical apparatus 20 of the sizing system of this invention is illustrated in schematic view. Block 22 represents the speed drive that drives the continuously moving web 10, shown in FIG. 1. The speed drive 22 is a variable speed drive, driven by a servo-motor 23 that is connected to a drive roller (not shown) supporting web 10 for movement.

The speed of the web 10 is sensed via an encoder 24 attached to the drive roller and motor 23. The controller 25 is an M-Track model, a Fenner Digital Control Unit manufactured by Fenner Industrial Controls Company of Maple Grove, Minnesota. The tie position that is sensed at station 13, shown in FIG. 1, is also fed to controller 25 via line 27.

The position of the hot knife at station 15, depicted in FIG. 1, is sensed and fed to controller 25 via line 28. The speed of the sealing drum 16 is sensed and a signal indicative thereof sent to controller 25 via line 29. A motor 30 is used to rotatively drive the sealing drum 16.

The controller 25 determines the "floating" center line from the average of the ties 11 passing the sensing station 13 and uses this information to control the hot knife sequencing and the web speed. The controller keeps the registration apparatus in synchronization with the subsequent sealing drum apparatus, so that there is a smooth, transitional flow between the sizing and sealing operations.

The controller 25 determines changes in the bag machine speed and has the ability to readjust the speed of the drive roller, i.e., the web speed, via servo-motor 23, in order to provide proper bag unit continuity.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A high-speed registration system for the manufacture of plastic bags, each of which having sinusoidally-shaped ties disposed about a center portion thereof, said high-speed registration system comprising:

a) means defining a feed path for a continuous web of plastic material from which individual bag units will be cut;

b) a continuous web of plastic material moving along said feed path at high speed, and having a plurality of sinusoidally-shaped tie patterns disposed therein;

c) a tie sensing station disposed along said feed path for sensing leading and trailing edges of each sinusoidally-shaped tie pattern in said continuous web, each sinusoidally-shaped tie pattern being associated with an individual bag entity and, therefore, representing a mid-portion of each bag to be cut from the continuous web, said leading and trailing edges of each sinusoidally-shaped tie, therefore, being used to determine a "floating" center line of each bag as it moves along said feed path; and d) a sizing station disposed along said feed path downstream of said sensing station for cutting individual bag units from said continuous web, based on a "floating" center line for each bag unit, as sensed upstream by said sensing station.

2. The high-speed registration system for the manufacture of plastic bags, in accordance with claim 1, further comprising:

a controller operatively connected to said sensing and said sizing stations, respectively, for determining a center line for each bag unit passing between said sensing and said sizing stations, and averaging each center line to provide a "floating" average of center lines for said sizing station, whereby individual bag units can be cut from said continuous web.

3. The high-speed registration system for the manufacture of plastic bags, in accordance with claim 1, further comprising a folding drum disposed adjacent said sizing station for receiving individual bag units seriatim.

4. The high-speed registration system for the manufacture of plastic bags, in accordance with claim 1, further comprising an adjustable speed drive for moving said continuous web along said feed path.

5. The high-speed registration system for the manufacture of plastic bags, in accordance with claim 4, wherein said adjustable speed drive includes a servomotor for driving said continuous web.

6. A high-speed registration system for the manufacture of plastic bags, each of which having curved ties disposed about a center portion thereof, said high-speed registration system comprising:

a) means defining a feed path for a continuous web of plastic material from which individual bag units will be cut;

b) a continuous web of plastic material moving along said feed path at high speed, and having a plurality of curved tie patterns disposed therein;

c) a tie sensing station disposed along said feed path for sensing leading and trailing edges of each curved tie pattern in said continuous web, each curved tie pattern being associated with an individual bag entity and, therefore, representing a mid-portion of each bag to be cut from the continuous web, said leading and trailing edges of each curved tie, therefore, being used to determine a "floating" center line of each bag as it moves along said feed path;

d) a sizing station disposed along said feed path downstream of said sensing station for cutting individual bag units from said continuous web, based on a "floating" center line for each bag unit, as sensed upstream by said sensing station; and e) a controller operatively connected to said sensing and said sizing stations, respectively, for determining a center line for each bag unit passing between said sensing and said sizing stations, and averaging each center line to provide a "floating" average of center lines for said sizing station, whereby individual bag units can be cut from said continuous web.

7. The high-speed registration system for the manufacture of plastic bags, in accordance with claim 6, further comprising a folding drum disposed adjacent said sizing station for receiving individual bag units seriatim.

8. The high-speed registration system for the manufacture of plastic bags, in accordance with claim 6, further comprising an adjustable speed drive for moving said continuous web along said feed path.

9. The high-speed registration system for the manufacture of plastic bags, in accordance with claim 8, wherein said adjustable speed drive includes a servomotor for driving said continuous web.

10. A high-speed registration system for the manufacture of plastic bags, each of which have sinusoidally-shaped ties disposed about a center portion thereof, said high-speed registration system comprising:

a) means defining a feed path for a continuous web of plastic material from which individual bag units will be cut;

b) a continuous web of plastic material moving along said feed path at high speed, and having a plurality of sinusoidally-shaped tie patterns disposed therein;

c) drive means for continuously moving said continuous web along said feed path at high speed;

d) a tie sensing station disposed along said feed path for sensing leading and trailing edges of each sinusoidally-shaped tie pattern in said continuous web, each sinusoidally-shaped tie pattern being associated with an individual bag entity and, therefore, representing a mid-portion of each bag to be cut from the continuous web; said leading and trailing edges of each sinusoidally-shaped tie, therefore, being used to determine a "floating" center line of each bag as it moves along said feed path;

e) a sizing station disposed along said feed path downstream of said sensing station for cutting individual bag units from said continuous web, based on a "floating" center line for each bag unit, as sensed upstream by said sensing station; and f) feedback control means operatively connected to said drive means for adjusting speed of the continuous web to provide proper sizing of said continuous web into individual bag units.

11. The high-speed registration system for the manufacture of plastic bags, in accordance with claim 10, further comprising:

a controller operatively connected to said sensing and said sizing stations and said feedback control, respectively, for determining a center line for each bag unit passing between said sensing and said sizing stations, and averaging each center line to provide a "floating" average of center lines for said sizing station, whereby individual bag units can be cut from said continuous web.

12. The high-speed registration system for the manufacture of plastic bags, in accordance with claim 10, further comprising a folding drum disposed adjacent said sizing station for receiving individual bag units seriatim.

13. The high-speed registration system for the manufacture of plastic bags, in accordance with claim 10, wherein said drive means comprises an adjustable speed drive for moving said continuous web along said feed path.

14. The high-speed registration system for the manufacture of plastic bags, in accordance with claim 13, wherein said adjustable speed drive includes a servomotor for driving said continuous web.

* * * * *